US008510865B2

(12) United States Patent
Pyfer et al.

(10) Patent No.: US 8,510,865 B2
(45) Date of Patent: Aug. 20, 2013

(54) CONVERTIBLE CLOTHING ARTICLE WITH CONTAINMENT POUCH

(76) Inventors: Christine Pyfer, Wayne, PA (US); Tracy Ryan, Wayne, PA (US)

( * ) Notice: Subject to any disclaimer, the term of this patent is extended or adjusted under 35 U.S.C. 154(b) by 0 days.

(21) Appl. No.: 13/209,959

(22) Filed: Aug. 15, 2011

(65) Prior Publication Data

US 2013/0042383 A1 Feb. 21, 2013

(51) Int. Cl.
*A41D 3/08* (2006.01)

(52) U.S. Cl.
USPC ..... 2/84; 2/202; 2/209.13

(58) Field of Classification Search
USPC ..... 2/84, 85, 86, 87, 88, 89, 93, 97, 202, 2/108, 69, 171.1, 209.13; 224/577; 383/4
See application file for complete search history.

(56) References Cited

U.S. PATENT DOCUMENTS

| | | | | | |
|---|---|---|---|---|---|
| 1,537,119 | A | * | 5/1925 | Keplinger | 2/84 |
| 1,702,143 | A | * | 2/1929 | Weisz | 2/84 |
| 1,993,149 | A | * | 3/1935 | Desmond | 2/84 |
| 2,109,951 | A | * | 3/1938 | Small et al. | 2/84 |
| 2,129,454 | A | * | 9/1938 | Wilkie | 2/84 |
| 2,136,393 | A | * | 11/1938 | Nelson | 2/84 |
| 2,376,345 | A | * | 5/1945 | Daiber | 2/173 |
| 2,462,269 | A | * | 2/1949 | Krempel | 2/84 |
| 2,971,198 | A | * | 2/1961 | Tomich | 2/84 |
| 3,275,106 | A | * | 9/1966 | Rush | 190/1 |
| 4,227,264 | A | | 10/1980 | Spector | |
| 4,502,155 | A | | 3/1985 | Itoi | |
| 4,543,669 | A | * | 10/1985 | Katz | 2/84 |
| 4,700,409 | A | * | 10/1987 | De Lott | 2/94 |
| 4,944,042 | A | | 7/1990 | DeWan | |
| 5,560,043 | A | * | 10/1996 | Armstrong | 2/69.5 |
| 5,787,504 | A | | 8/1998 | Wu | |
| 5,794,263 | A | * | 8/1998 | Carman | 2/84 |
| 5,850,634 | A | | 12/1998 | Toombs | |
| 5,884,331 | A | * | 3/1999 | Barajas | 2/69 |
| 5,901,375 | A | * | 5/1999 | Davis | 2/84 |
| 6,233,742 | B1 | * | 5/2001 | Yungkurth | 2/160 |
| 6,243,873 | B1 | * | 6/2001 | Aliff | 2/88 |
| 6,256,796 | B1 | * | 7/2001 | Fleming | 2/209.13 |
| 6,370,692 | B1 | | 4/2002 | Duyn | |
| 2005/0144695 | A1 | * | 7/2005 | Aldridge et al. | 2/69 |
| 2007/0083983 | A1 | * | 4/2007 | Barclay | 2/227 |
| 2008/0196146 | A1 | * | 8/2008 | Grilliot et al. | 2/202 |
| 2009/0055991 | A1 | * | 3/2009 | Johnson et al. | 2/84 |
| 2009/0241235 | A1 | * | 10/2009 | Weinreb | 2/84 |
| 2009/0249527 | A1 | * | 10/2009 | Hunte | 2/84 |

FOREIGN PATENT DOCUMENTS

| | | | | |
|---|---|---|---|---|
| CA | 2222908 | A1 | * | 6/1999 |
| JP | 08170205 | A | * | 7/1996 |

* cited by examiner

*Primary Examiner* — Khoa Huynh
*Assistant Examiner* — Megan Brandon
(74) *Attorney, Agent, or Firm* — Daniel Boudwin

(57) ABSTRACT

A convertible article of clothing with a compartmented hood section adapted to accept the entire garment therein and provide a carrying pouch for a user. The article comprises a hooded garment, such as a sweatshirt or jacket, wherein the hood acts as a head covering and a convertible pouch with zipper closure. The hood comprises an internal lining which is not visible when in a closed position, and is operably accessed via a vertical zipper closure. When in an open position, the lining is exposed and the hood may be turned inside out to allow the entire garment to fold into the lining. The condensed garment then becomes a satchel, which allows improved storage or transport. The lining is optionally water and stain resistant to offer a level of protection for the garment when in a stowed position.

8 Claims, 3 Drawing Sheets

CONVERTIBLE CLOTHING ARTICLE WITH CONTAINMENT POUCH

BACKGROUND OF THE INVENTION

1. Field of the Invention

The present invention relates to convertible garments and clothing articles with internal storage means. More specifically, the present invention relates to a hooded garment with an interior lining therein, which is operably accessed by a user to form a pouch or garment-enveloping cover. The pouch may be used to hold items therein, or inverted to form a cover around the rest of the garment. Once condensed into the out-folded pouch, the garment is in a stowed position that facilitates easy transport and storage.

2. Description of the Prior Art

Convertible clothing articles are devices that operate as a garment, while also providing a novel means to transform into another form that allows functionality beyond fashion or clothing. These include articles with interior pouches, unraveling or concealed hoods or extensions, or similar devices that improve the usefulness of the garment beyond a single function. Articles of clothing that are condensable or collapsible into a stowed state are particularly useful for those who are required to travel or carry several clothing items while away from home. Traveling individuals who require reduced luggage, backpackers and parents all benefit from improved storage of clothing articles, as these can be stowed in greater number or in a more condensed form to suit their given needs.

Parents of young children are especially aware of the obstacles associated with carrying several articles of clothing while traveling. Young children are prone to dirtying their clothes in several ways, including spillage of food or drink items, spit-ups or simply playing in dirty or outdoor environments. Parents often carry several articles of clothing for a specific occasion for just this reason, which can lead to bulky travel bags or cluttered vehicles. Parents resort to condensing clothing in vacuum bags, or utilizing larger carrying bags, especially if the parent is responsible for several children or are away from home for an extended period of time.

An article of clothing is needed that serves two functions, first as a traditional garment, wherein its normal operation is not impacted or altered, and second as a garment that is convertible into a self-containing carry pouch that reduces its volume to an easily-carriable and storable structure. The present invention provides such as a device, wherein a hooded garment is provided with an internal lining that may be unfolded to provide an outer layer that envelopes the rest of the garment. The lining is accessed by a fore-aft, closable seam that is folded back to reveal the inner lining. The lining may function as a pouch while the user is wearing the garment, or preferably as a means to surround and condense the garment into a carriable state. The lining may further be provided in waterproof or stain resistant form, wherein its material also functions to keep the internal garment clean and dry.

Several articles of clothing have been disclosed in the prior art for converting a garment from a wearable configuration into a stowed configuration. These include articles with internal pouches or structures that are adapted to overlap the entire garment when not being worn. These articles have familiar design elements for the purposes of collapsing a garment and providing a convertible structure for a user; however none are disclosed with an interior lining within a hooded garment that does not interfere with normal operation thereof, while providing a means to stow the entire garment therein when desired.

U.S. Pat. No. 4,944,042 to DeWan is one such device that describes an article of clothing wherein a tubular portion is a functional element during normal operation, and also forms a container for the article when the article is not in use. The tubular portion comprises a container-forming device that acts as a storage bag for the entire article of clothing when not being worn by the user. The container-forming device is contemplated for use along a sleeve or leg of a garment, which forms a tubular section with two ends that are sealed to form a pouch for the entire device. Its structure and mode of condensing a garment both differ from the present invention, wherein a hooded patch is provided.

U.S. Pat. No. 5,787,504 to Wu is another device that describes a foldable bag attached to an article of clothing, such as a coat or jacket, such that the bag is condensed within an edge of the article of clothing when not in use. The device comprises two bags, a smaller and larger bag, which when unfolded act to secure the article of clothing and provide a bag for the user. The bag of Wu is sewn into an edge of the clothing, such as along a collar or neck area. This requires volume within the device to hold the two bags when not in use, which can become bulky or uncomfortable if not condensed properly. The present invention provides an inner lining that conforms to a clothing hood line when not in use. The lining does not interfere with the operation or natural positioning of the hood, as would occur without the presence of the lining.

U.S. Pat. No. 4,227,264 to Spector describes a convertible ensemble of clothing that can be used to satisfy a plurality of apparel requirements. The ensemble comprises a long jacket and a pair of slacks, wherein an internal liner provides a removable skirt that may be used to replace the slacks. A removable hood from the jacket provides a carrying bag to place the slacks in after their replacement. While the Spector device provides a modular clothing article, and one that may allow a user to convert from one type of look to another, it does not provide a means to carry the ensemble in an internal carrying pouch that is operably accessed within the hood of the device. Its structure and intent differ from the present invention.

U.S. Pat. No. 5,850,634 to Toombs describes a lined article of clothing, such as a jacket or similar outerwear, wherein the lining provides a carrying device for the clothing when in a stowed position. The lining is concealed between a rear panel of the jacket shell and the jacket lining. The lining may be accessed and folded around the jacket to envelope the same, creating a carrying device wherein the jacket is contained within its interior volume. This device is similar to the Wu invention, wherein an internal carrying structure that forms a carrying bag or pouch is housed within the article. The placement of the liner and its size can interfere with normal operation of the jacket or create unwanted bulk in regions thereon. The present invention provides a convertible hood device that operates as a liner when in a stowed position, and as an enveloping pouch for the garment when in a working position.

U.S. Pat. No. 4,502,155 to Itoi describes an outerwear garment for outdoor or travel activities, comprising a back portion with a pocket capable of receiving the entire garment therein. Straps are provided for holding the condensed garment and bag when stowed together. The pouch is placed along the back of the outerwear, and is adapted for use in situations wherein a user may be unsure of weather conditions, but is not willing to wear a jacket. The pouch serves as a carrying case for the outerwear garment that can be easily accessed if necessary. While useful for its given requirement, the Itoi invention is ideally suited for sports and outdoor activities, and less ideal for use with all types of garments. The present invention may be utilized with all forms of garments having a hooded upper region, including sportswear, casual or outerwear. The present invention provides a storage means that functions as a hidden feature when not in use, and is not intended to incorporate a large area on the garment when in a stowed position.

Finally, U.S. Pat. No. 6,370,692 to Duyn describes a waterproof garment that comprises a hooded jacket that is convertible into a ventilated carrying back for storing the garment. The device provides an interior pouch region within the hooded region, and a location to store the garment when not in use. However, the device requires the hood to be detached from the body of the jacket when stowing the garment therein, which differs in structure from the present invention. The Duyn device is adapted for use with waterproof, all-weather jackets, as opposed to incorporation into normal outerwear or hooded sweatshirts. The device requires a detachable hood for operation, as opposed to a vertical slit that unfolds an inner lining that acts as an outer cover for housing the garment therein.

The devices in the prior art have several disadvantages with regard to the present invention, including a lack of concealment when the packaging means is in a stowed position. The present invention provides an interior lining within a hood of a garment wherein the hood may function as a pouch for the user or a means to envelope the garment and reduce its size for improved storage or transport. Its structure is substantially divergent in design elements from the prior art, and consequently it is clear that there is a need in the art for an improvement to existing convertible hooded garment devices. In this regard the instant invention substantially fulfills these needs.

SUMMARY OF THE INVENTION

In view of the foregoing disadvantages inherent in the known types of convertible hooded garments now present in the prior art, the present invention provides a new convertible hood structure wherein the same can be utilized for providing convenience for the user when storing articles within a hood internal lining and stowing the entire garment therein.

It is therefore an object of the present invention to provide a new and improved hooded garment device that has all of the advantages of the prior art and none of the disadvantages.

Another object of the present invention is to provide a convertible hood structure for a garment that provides an interior lining that may serve as an internal pouch.

Another object of the present invention is to provide a convertible hood structure for a garment that provides an interior lining that may serve as a means to surround the entire garment and provide a cover therefor, reducing its size into a condensed state for improved carriage and storage.

Another object of the present invention is to provide a convertible hood structure for a garment that is adapted to condense additional articles of clothing in addition to the body structure of the hooded garment itself.

Another object of the present invention is to provide an interior lining for a hooded garment that does not interfere with the hood's normal operation, and does not provide any external cues of its presence.

Still another object of the present invention is to provide a convertible hooded garment that may be provided in several forms, including casual wear, sportswear, outerwear, and may further be provided for individuals of all ages.

A final object of the present invention is to provide a garment of resilient construction that incorporates a robust means for securing the interior lining, and one that is easily cleaned Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
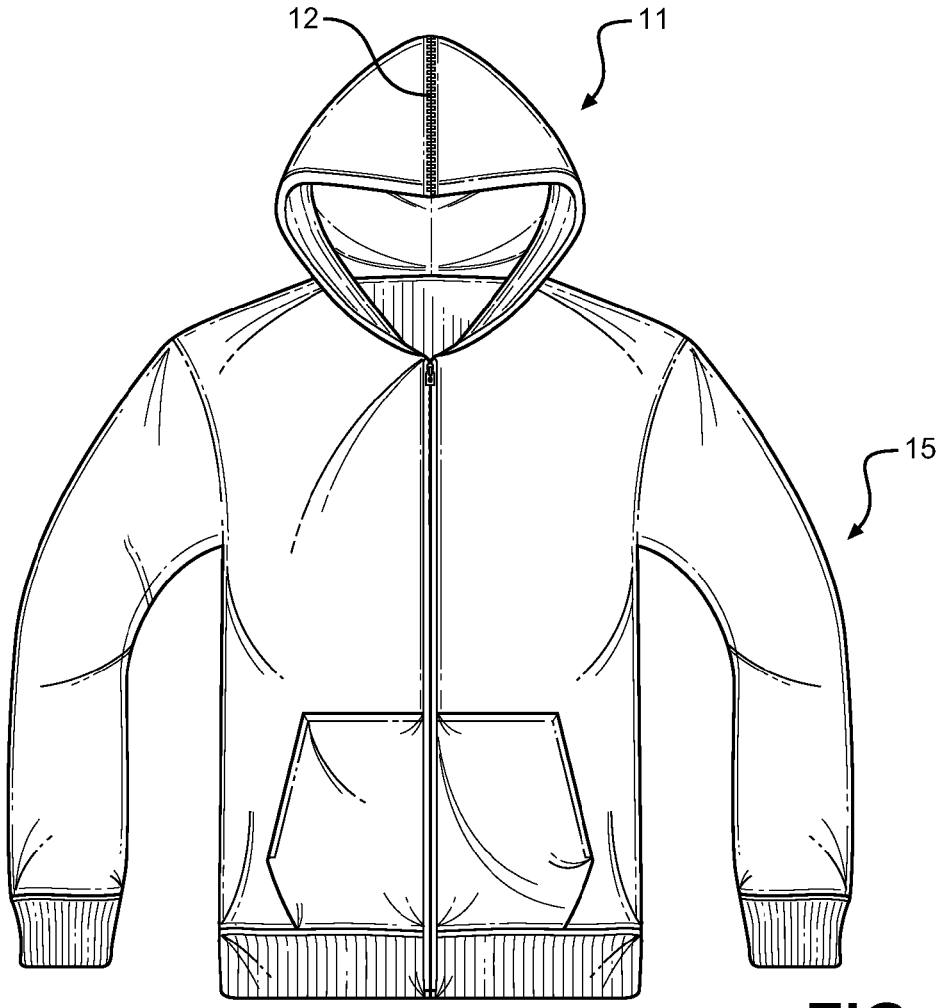
FIG. 1 shows a front view of a typical hooded garment as described by the present invention, wherein the hood internal pouch is in a closed position.

Reference is made herein to the attached drawings. Like reference numerals are used throughout the drawings to depict like or similar elements of the convertible hooded garment. For the purposes of presenting a brief and clear description of the present invention, the preferred embodiment will be discussed as used for collapsing the entire garment into a condensed state. The figures are intended for representative purposes only and should not be considered to be limiting in any respect.

Referring now to FIG. 1, there is shown a front view of a garment as contemplated by the present invention, wherein the garment includes a hooded upper region 11 and a body region 15. The hooded region 11 comprises an interior liner that forms a closed storage pouch within the interior of the hood. The interior liner is secured within the interior of the hood 11 by a closure means 12 that runs fore-aft along the hood where a typical hood seam would typically be located. The closure means 12 keeps the liner internal to the hood and in a stowed position when not in use. The liner itself comprises a section of material that is sewn along the two edges of the closure means, forming an internal pouch that can be withdrawn from the hood interior for cleaning. The user may access the liner by opening the closure means 12, providing access to the pouch for storing items while wearing the garment, or for inverting the pouch when stowing the garment therein. The design of the garment and the closure means 12 are such that one without specific knowledge would be unaware of its presence. It is desired to provide the novel features of the present invention with low visual signature, wherein the lined hood appears as a typical hood region on a garment of this type.

Figure 2:
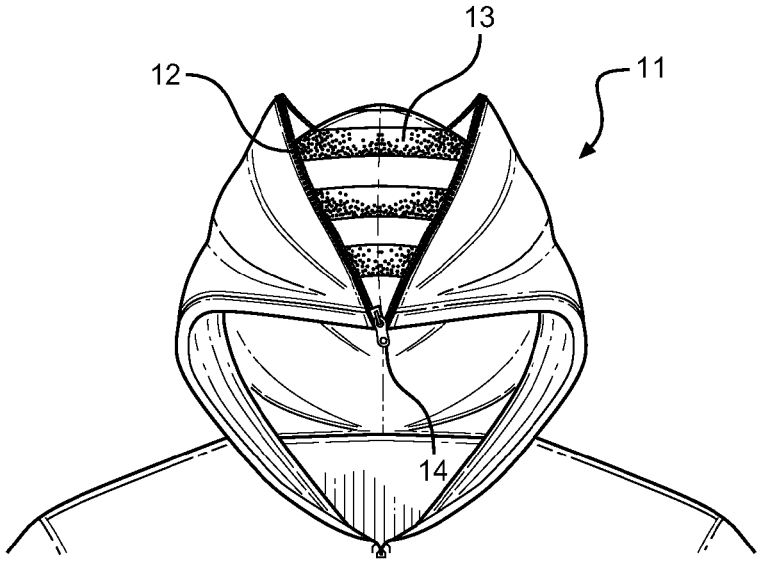
FIG. 2 shows a front view of a typical hooded garment as described by the present invention, wherein the hood internal pouch is in an open position and the interior liner is visible.

Referring now to FIG. 2, there is shown a front view of the garment hooded region 11, wherein the closure means 12 is opened to reveal the interior liner, which can then be accessed by a user. The closure means 12 is preferably a zip fastener mechanism (zipper), wherein two adjoining surfaces of the hood 11 are operably joined or separated as desired along a centerline seam that runs lengthwise along the hood 11. The liner 13 is a continuous patch of material that is sewn along the closure means 12 opening, forming a pouch, while the hood is separated into two outer surfaces by the closure means 12 when opened. The hood comprises an inner and outer surface sandwiching the interior liner 13. The clasp 14 for the zipper 12 is also preferably positioned at the base of the user's neck when the zipper 12 is in a closed position, as its appearance is less obvious in this position and is less prone to contact the user during normal operation of the hood. The interior liner 13 forms a closed pouch within the interior of the hood 11, allowing a space for storage if desired or a surface that forms around the body of the garment when condensed therein.

Figure 3:
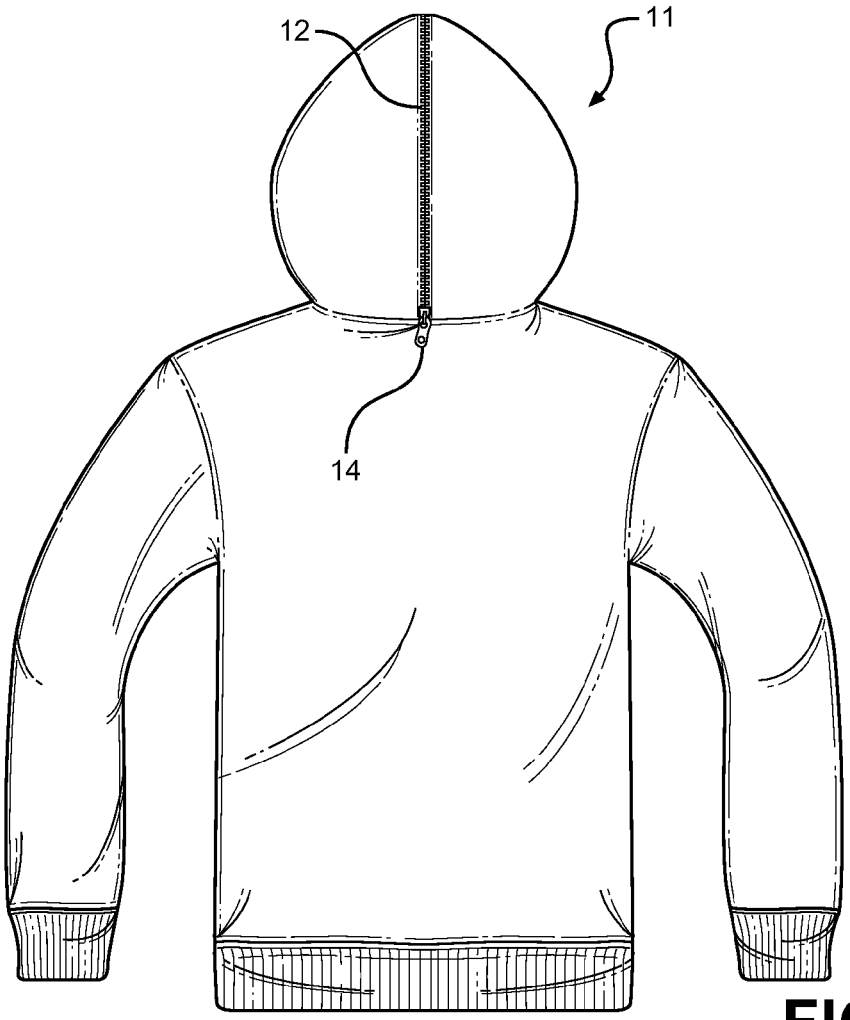
FIG. 3 shows a rear view of a typical hooded garment as described by the present invention, wherein the hood internal pouch is in a closed position.

Referring now to FIG. 3, there is shown a rear view of the typical hooded garment as described by the present invention, wherein the hood internal pouch is in a closed position. The clasp 14 of the closure means rests along the base of the neck line, behind the hood 11. During the course of normal wear, the hood 11 flaps backward onto the body of the garment and over the closure clasp 14 to provide concealment thereof. The interior liner is situated neatly against the walls of the hood to provide an internal structure that is not bulky or clumpy, allowing the hood 11 to act as normally provided in similar garments.

Figure 4:
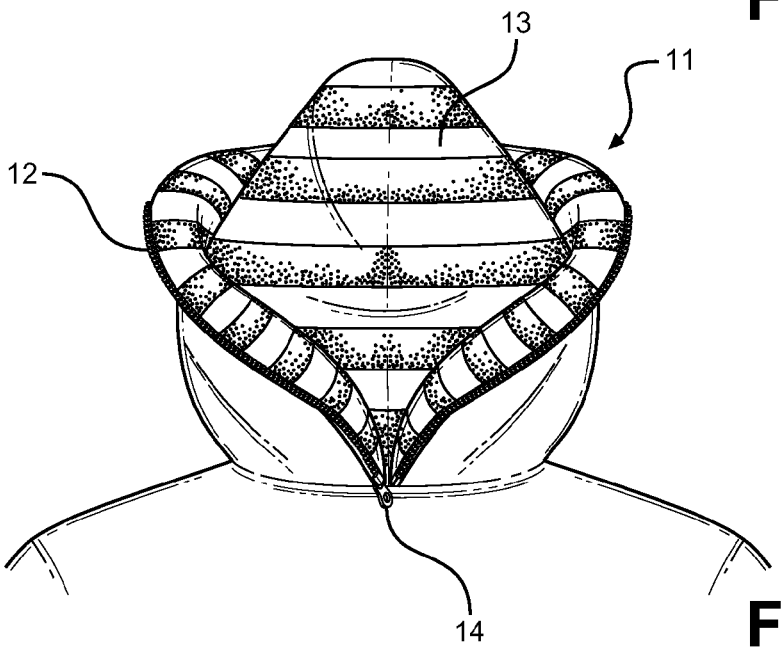
FIG. 4 shows a rear view of a typical hooded garment as described by the present invention, wherein the hood internal pouch is in an open position and the interior liner is visible.

Referring now to FIG. 4, there is shown the interior liner 13 being folded over the hood 11 to begin the stowage process. The closure means 12 has been completely opened to reveal the lined pouch of the hood. The two surfaces of the hood 11 are folded backward to reveal the liner as the body of the garment is condensed into a smaller volume for packaging therein.

Figure 5:
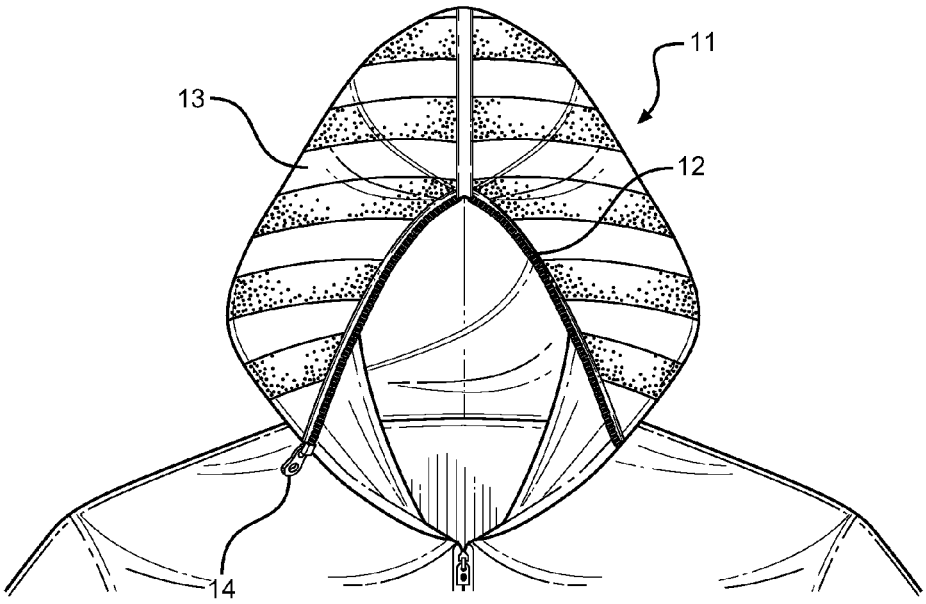
FIG. 5 shows a front view of the internal liner being inverted, folding around the rest of the garment to provide enclosure thereof.

Referring to FIG. 5, there is shown a view of the interior liner 13 being further folded over the hood region 11 of the garment, wherein the outer surfaces of the hood 11 are folded into the pocket created after the liner is inverted. The inverted liner forms a pouch that includes an interior volume; the interior volume is utilized to forcibly condense the remaining elements of the garment thereinto.

Figure 6:
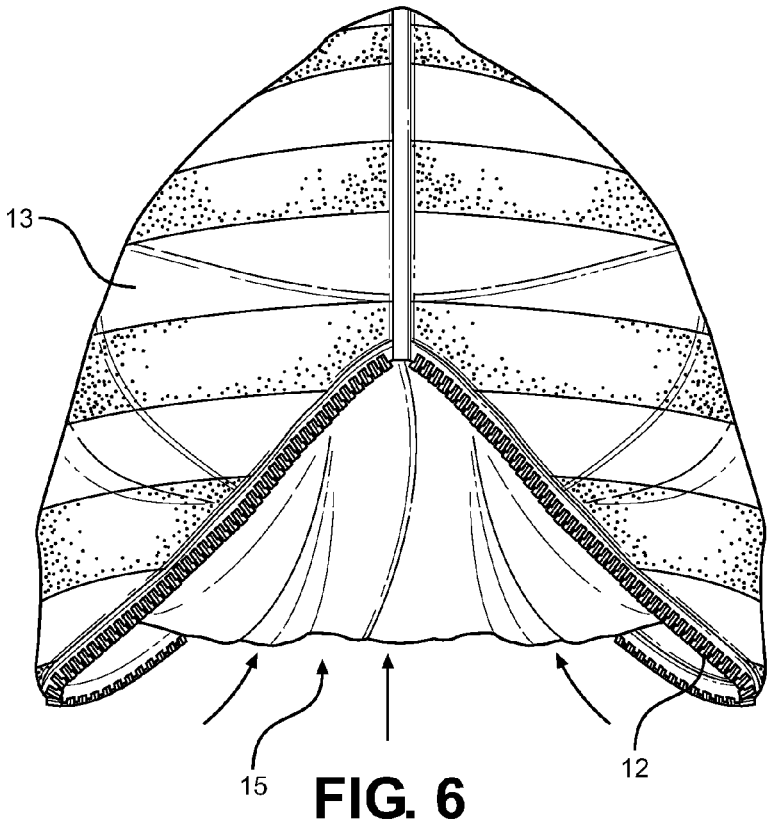
FIG. 6 shows the device in a stowed position, wherein the garment is condensed into the liner for zipper closure thereof.

Finally referring to FIG. 6, there is shown the final step in the process of condensing the garment of the present invention into a stowed state within the interior of the hood interior liner 13. The garment 15 has been stuffed into the liner to provide a garment that is reduced in volume and is easier to handle, carry and store. The closure means 12 may be provided in a dual sided clasp design, allowing closure means 12 to be closed shut after the garment has been condensed therein, providing a protective seal that prevents unraveling or dirt and moisture from entering the pouch. The final, stowed state of the garment provides a user with the ability to pack many articles in a larger bag, to hand carry the stowed garment or to store the garment with reduced volume.

The size of the hood 11 with respect to the body of the garment 15 may vary to provide a larger carrying pouch for additional articles, including a full outfit one might desire. The hood 11 may be sized to carry pants, socks and other articles that form an entire ensemble, which further improves storage and transport of garment articles while on the go. Of particular interest are children's and toddler's clothing, wherein an entire set of clothing may be condensed into the hood 11, allowing specifically coordinated garments to be condensed together to aid parents and guardians while traveling or packing.

FIGS. 4, 5 and 6 provide a step-by-step process for accessing the interior liner of the hood, inverting the surface of the hood to reveal the liner, and finally enveloping the entire garment with the liner. The liner may be provided in a water or stain resistant configuration to provide a stowed device that employs an outer surface that is water resistant and protective of the interior garment. This provides a user with the ability to carry or store the device without risk of damaging or moistening the garment when later unraveling it for use. Alternate embodiments of the closure means further comprise strips of hook and loop fastening material or a row of buttons or snaps.

The present invention is intended to advance the art of convertible garments, and in particular, garments with internal pouch and stowage means. The present invention may be utilized by individuals of all sizes and ages, and provide a convenient means to condense a larger garment into a smaller volume, providing several advantages for the user. The garments contemplated for use with the present invention include any hooded article of clothing. The liner itself is sewed between two layers of the hood and a closure means is provided for access thereto, while the size of the hood in relation to the garment must be appropriate to allow adequate volume for condensing the garment thereinto. Further, the present invention is intended to by simple to construct and incorporated into any garment line utilizing a hood with minimal cost or production complications.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A convertible garment comprising:

a hooded region and garment body region, wherein said hooded region is directly connected to said garment body region;

said hooded region comprising an outer and inner surface, an inner liner and a closure means;

said closure means splitting said hooded region into a first and second outer surface;

said inner liner sewn to opposing interior sides of said closure means;

said first and second outer surfaces are designed to be folded downward when said closure means is unfastened, exposing said interior liner as a head covering, wherein said interior liner is positioned on the exterior of said hooded region when said interior liner is inverted;

said inner liner is designed to invert over said hooded region outer surfaces forming an internal volume, and said interior liner designed to fully invert into a storage pouch wherein said interior liner is disposed along said storage pouch exterior and wherein said storage pouch is designed to receive and store said garment body region within said internal volume when not in use.

2. A device as in claim 1, wherein said closure means runs along a centerline of said hooded region.

3. A device as in claim 1, wherein said closure means comprises a zip closure mechanism.

4. A device as in claim 1, wherein said closure means comprises hook and loop fasteners.

5. A device as in claim 1, wherein said closure means comprises a button closure.

6. A device as in claim 1, wherein said closure means comprises a snap closure.

7. A device as in claim 1, wherein said inner liner comprises a water resistant material.

8. A device as in claim 1, wherein said inner liner comprises a stain resistant material.

* * * * *